US006105496A

United States Patent [19]

Mayr

[11] Patent Number: 6,105,496

[45] Date of Patent: Aug. 22, 2000

[54] APPARATUS AND METHOD FOR THREADING A PRINTING MATERIAL WEB

[75] Inventor: Robert Mayr, Neusäss, Germany

[73] Assignee: MAN Roland Druckmaschinen AG, Offenbach am Main, Germany

[21] Appl. No.: 09/205,867

[22] Filed: Dec. 4, 1998

[30] Foreign Application Priority Data

Dec. 5, 1997 [DE] Germany ..... 197 54 106

[51] Int. Cl.[7] ..... B41F 13/02

[52] U.S. Cl. ..... 101/228; 226/92

[58] Field of Search ..... 101/219, 226, 101/227, 228, 232, 231; 226/91, 92

[56] References Cited

U.S. PATENT DOCUMENTS

| | | | |
|---|---|---|---|
| 4,987,830 | 1/1991 | Fukuda et al. | 101/228 |
| 5,052,295 | 10/1991 | Suzuki et al. | 101/227 |
| 5,307,970 | 5/1994 | Shibuya et al. | 226/92 |
| 5,400,940 | 3/1995 | Sato et al. | 226/4 |

FOREIGN PATENT DOCUMENTS

| | | |
|---|---|---|
| 29 20 684 C2 | 10/1983 | Germany . |
| 44 09 693 C1 | 9/1995 | Germany . |

*Primary Examiner*—Ren Yan
*Attorney, Agent, or Firm*—Cohen, Pontani, Lieberman & Pavane

[57] ABSTRACT

The invention provides an aid for threading a printing-material web or part printing-material webs which are produced from the printing-material web by a longitudinal cutting device. The aid enables threading by a threading apparatus even in the region of offset bars. For this purpose, guide bars are introduced into the web course during the threading operation. The printing-material web is threaded through the offset bars but wraps around these guide bars instead of the offset bars. The guide bars are then either withdrawn from or pivoted out of the web course so that the printing-material web can be pulled taut on the guide bars. Likewise, it is also possible for offset bars mounted on one side to undertake the function of the guide bars during the insertion operation.

8 Claims, 5 Drawing Sheets

APPARATUS AND METHOD FOR THREADING A PRINTING MATERIAL WEB

BACKGROUND OF THE INVENTION

1. Field of the Invention

The invention relates to a threading apparatus for threading the start of a printing-material web using a threading point in a web-fed rotary printing machine and a threading method for threading the start of a printing-material web.

2. Description of the Related Art

In web-fed rotary printing machines for printing printing-material webs such, for example, as paper webs it is occasionally necessary to laterally offset the printing-material web. The lateral offsetting is required, for example, when printing is being carried out with a printing-material web which covers only the left or the right half of the cylinders or which is only one quarter of the possible width of a four-page-width printing machine. If the half-width printing-material web is intended to be folded over a folding fonner which is arranged centrally in the middle of the full-width printing-material web, then it is necessary for the half-width printing-material web to be offset by one quarter of the width of the machine to the right or to the left, for which purpose a pair of turner bars arranged parallel to each other is used.

In another situation which requires lateral offsetting, printing-material webs which occupy the full width of the cylinders may be cut in the longitudinal direction by a longitudinal cutting device into two halves with the requirement that both halves of the full width printing-material web are then to be laid one above the other so that they are folded together in the longitudinal direction via a folding former. To place the halves of the full length printing-material web one above the other, each half must be offset toward the center, if the folding former is arranged centrally. Likewise, however, it is also conceivable that only one of the two part printing-material webs is offset until it runs above or below the other part printing-material web.

When a printing-material web is required to be laterally offset in relation to its original running direction by offset bars, difficulties arise with regard to the use of a threading apparatus. Normally, in these cases threading apparatuses thread the printing-material webs only as far as the region of the offset bars. The automatic threading is then stopped, the leading end of the printing-material web is removed from the threading point of the threading apparatus and is led further manually through the region of the turner bars.

DE 44 09 693 C1 discloses a prior art apparatus in a web-fed rotary printing machine for threading part printing-material webs which are produced from a single printing-material web by a longitudinal cutting device, in which the part printing-material web produced in the longitudinal cutting device runs further over offset bars, being threaded during the threading operation by a flexible threading point fastened to a lateral sheet chain. The lateral sheet chain has rollers and is also movable along the longitudinal axis direction of the rollers. The guide rail for the part printing-material web running over the offset bars runs outside the displacement or pivoting region of the offset bars, to the side of the running path of the part printing-material web. The construction disclosed by DE 44 09 693 C1, which enables the automatic threading of the part printing-material web through the offset bars, is a complicated construction and permits automatic threading only if one and the same part printing-material web is to be laid above the other part printing-material web and if the same lateral offset is always desired.

SUMMARY OF THE INVENTION

The object of the invention is to enable automatic threading of a printing-material web through the structure of the offset bars. The object of the invention is to also enable automatic threading of a part printing-material web that has been produced in a longitudinal cutting device, without a lateral sheet chain having to be used and without a guide roll having to be used which has a complicated course within the region of the offset bars and which permits only a single possible offset.

This object is achieved by a threading apparatus for threading the start of a printing-material web through an offset bar region of a rotary printing machine using a pulling device for pulling a threading point connected to the start of the printing-material web. The apparatus includes a guide rail arrangable parallel to a longitudinal path of the printing-material web in the offset bar region for guiding the pulling device so that the threading point is guidable through the offset bar region by said guide rail. The apparatus also include a pair of parallel offset bars arranged in said offset bar region for laterally offsetting the printing material web and guide means extendable perpendicular to the longitudinal path for receiving the printing-material web during the threading operation so that the printing material is threadable around the guide means instead of the offset bars. The guide means is removable from the longitudinal path.

According to the invention, guide bars which are insertable into the course of the web are inserted in the region of the offset bars so that the printing-material web may be wrapped around said guide bars instead of the offset bars. The guide bars are arranged so that the printing-material web being threaded does not experience a lateral offset during the threading operation but continues to run in a straight line. Since the web does not have to be laterally offset during the threading operation, the guide rails for the pulling means of the threading apparatus can continue to run even in the region of the offset bars and as far as the folding former downstream of the offset region. Therefore, the printing-material web can be threaded as the folding former without any manual intervention being necessary. After the threading operation is complete, the guide bars are withdrawn from the web course. This operation leaves play of the printing-material web in the region of the offset bars. That is to say, the printing-material web hangs down loosely in the region of the offset bars after the guide bars are removed. After removal of the guide bars, the printing-material web can be pulled taut either manually or by machine, the desired specific lateral offset determined by the offset bars also resulting while the web is being pulled taut. This sequence is also correspondingly true for a part printing-material web which is produced after the printing-material web has been cut longitudinally by a longitudinal cutting device. If this part printing-material web is to be drawn above another printing-material web by offset bars, the procedure according to the invention is that, during the threading operation, the action of the offset bars is suppressed by additional guide bars which guide the newly produced part printing-material web further in a straight line. The leading end of the newly produced part printing-material web is gripped by a threading point located in the region downstream—in relation to the web running direction—of the longitudinal cutting device, for which purpose the latter are gripped, for example, as is disclosed by DE 44 09 693 C1, by magnetic attraction by means of two covering pieces enclosing the end of the part printing-material web at the top and bottom.

A particular advantage of the apparatus according to the invention is that, after the threading operation has been completed, any desired offset may be set within the displacement range of the offset bars. It goes without saying that the invention may also be used if, after a printing-material web has been cut by a longitudinal cutting device into two part printing-material webs the two part printing-material webs are offset toward the center.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout t several views.

DETAILED DESCRIPTION OF THE PRESENTLY PREFERRED EMBODIMENTS

Figure 1A:
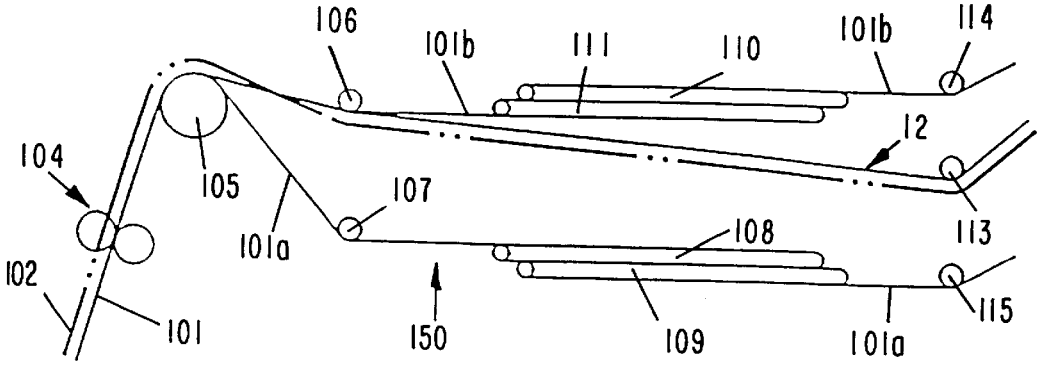
Fig. 1a PRIOR ART
FIG. 1*a* is a side view of an offset bar region of a prior art printing machine in which first and second part printing-material webs are guided one above the other.
Figure 1B:
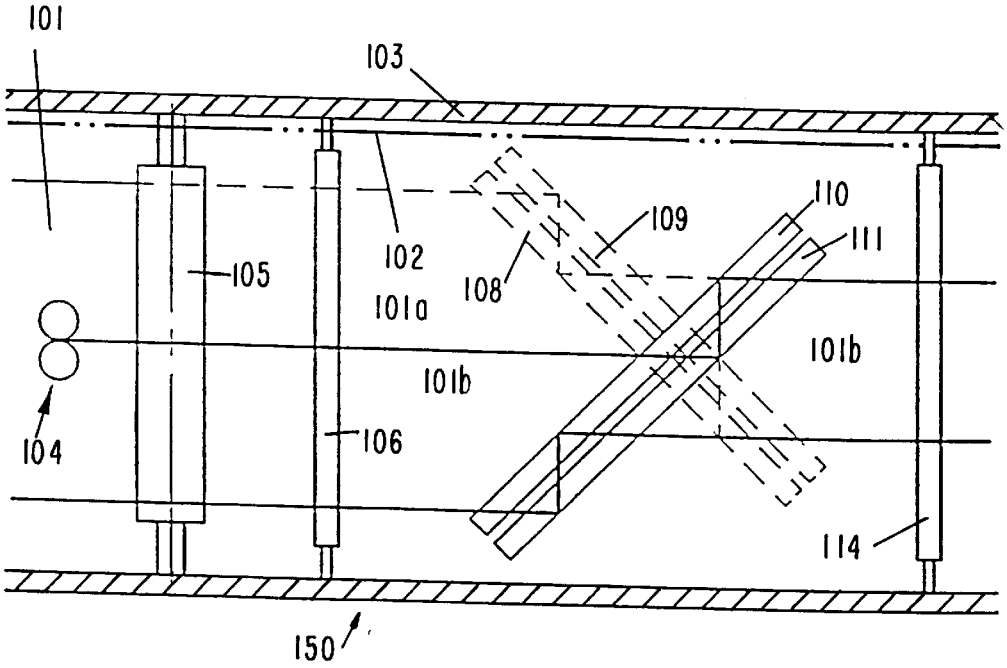
Fig. 1b PRIOR ART
FIG. 1*b* is a plan view of the offset region of the printing machine of FIG. 1*a*.

FIGS. 1*a* and 1*b* show a printing-material web 101 threaded into a rotary printing machine 150 by a threading apparatus according to the prior art. In FIG. 1*a* and all the following Figures, only one guide rail 102 of the threading apparatus is shown in schematic form. The schematic depiction of the guide rail 102 represents the entire threading apparatus, whose construction is known and can be taken, for example, from DE 44 09 696 C1. The guide rail 102 always runs parallel to a side wall 103 (see FIG. 1*b*) of the web-fed rotary printing machine without any lateral displacements or bends. A longitudinal cutting device 104, formed for example by a circular knife, cuts the printing-material web 101 into first and second part printing-material webs 101*a* and 101*b*. The first and second part printing-material webs 101*a* and 101*b* are then fed over a pull roll 105 and respective guide rolls 106 and 107. The first and second part printing-material webs 101*a* and 101*b* are then fed to a respective pair of offset bars 108, 109 and 110, 111, which have the effect that the part printing-material webs 101*a* and 101*b*, after they have run over said bars, lie one above the other and, for example, can be folded together in the longitudinal direction by means of a downstream folding former.

In the prior art device of FIG. 1*a*, the printing-material web 101 can only be threaded over the region of the offset bars 108–111 by the threading apparatus 102 if the longitudinal cutting device 104 was not activated and the printing-material web 101 is consequently not cut. In that case, the printing-material web 101 would run over a threading path 112 without wrapping around the offset bars 108–111.

When the printing-material web 101 is cut by the longitudinal cutting device 104 into the first and second part printing-material webs 101*a* and 101*b*, the threading point (not shown) of the threading apparatus must be removed from the leading end of the printing-material web 101 since the threading apparatus 102 can not be allowed to cover the same path in the region of the offset bars 108–111 as the first and second part printing-material webs 101*a* and 101*b*. The only way to further thread the first part printing-material web 101*a* is if the first part printing-material web 101*a* is not guided over the turn bars 108, 109, but continues to run in a straight line. A further precondition for further threading the first part printing-material web being that the threading point is not wider than the first part printing-material web 101*a*, since it would otherwise collide with the longitudinal cutting device 104. If the printing-material web 101 is not cut by the longitudinal cutting device 104, and if it does not run over the offset bars 108 to 111, it is drawn by means of the threading apparatus 102 over a threading path 112 and runs over a guide roll 113.

Figure 2A:
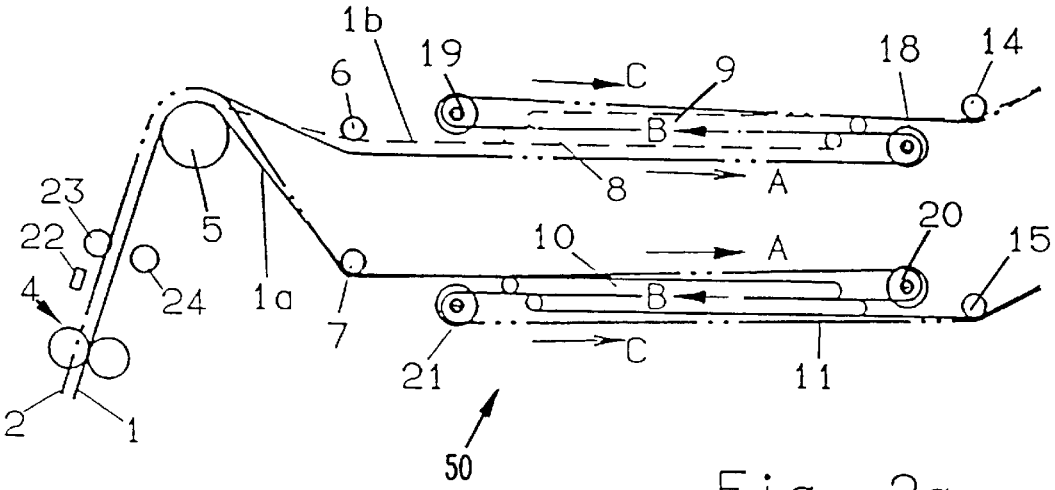
FIG. 2*a* is a side view of an offset bar region of a rotary printing machine according to an embodiment of the present invention.
Figure 2B:
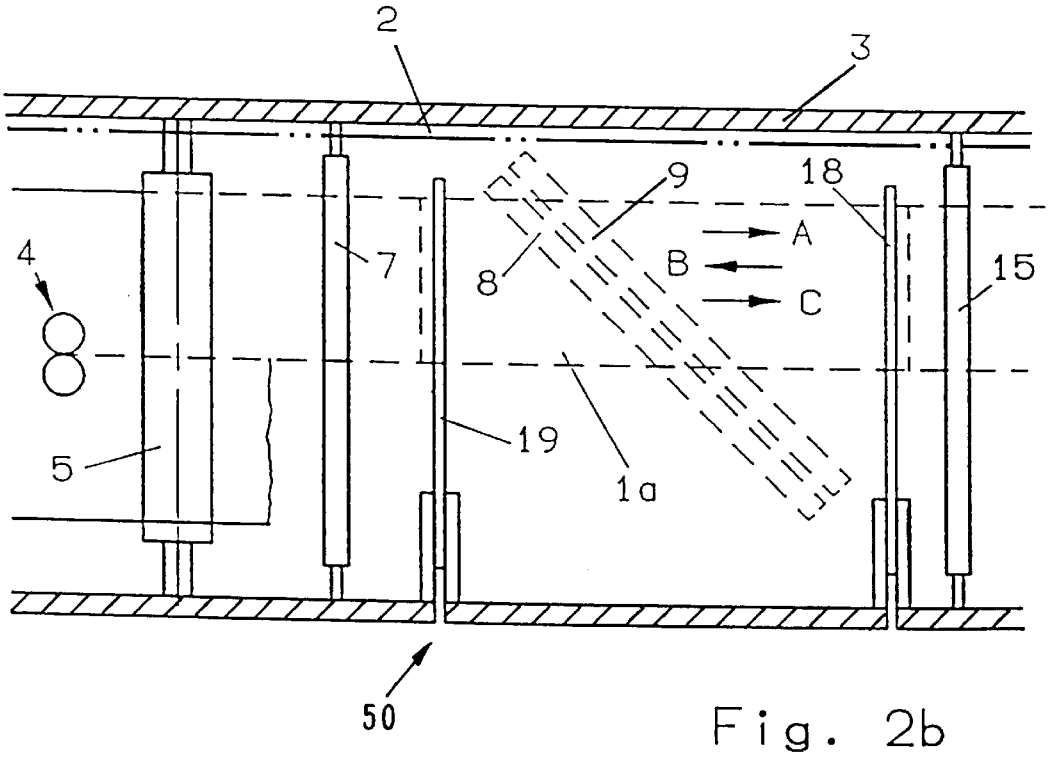
FIG. 2*b* is a plan view of the offset bar region of the printing machine of FIG. 2*a* showing one of the part printing-material webs.
Figure 2C:
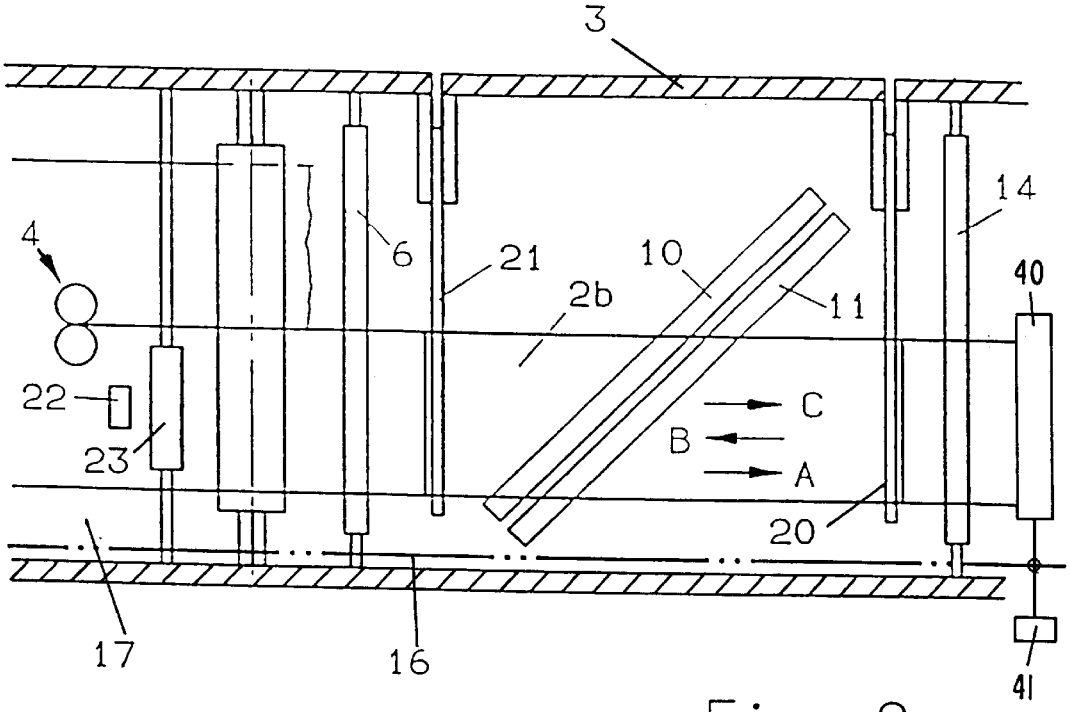
FIG. 2*c* is a plan view of the offset bar region of the printing machine of FIG. 2*a* showing the other of the part printing-material webs.

If the printing-material web 101 is cut by means of the longitudinal cutting device 104, the first and second part printing-material webs la and 1*b* produced from it run through between the offset bars 108, 109 and 110, 111 and are then further guided over guide rolls 114, 115. FIGS. 2*a* through 2*c* show a rotary printing machine 50 according to an embodiment of the invention in which it is possible for first and second part printing-material webs 1*a* and 1*b* that have been cut by a longitudinal cutting device 4 to be threaded through the region of offset bars 8–11 by a first threading apparatus 2 and a second threading apparatus 16 which begins at a point 17 at which the second part printing-material web 1*b* is produced. To accomplish this, guide bars 18, 19 and 20, 21 are arranged in the course of the first and second part printing-material webs 1la and 1*b* in the region of the offset bars 8–11. Referring to FIGS. 2*a* and 2*b*, the leading end of the printing-material web 1 and the first part printing-material web 1*a* produced from it is always guided further parallel to the side wall 3, the first part printing-material web 1*a* being guided firstly in the direction of arrow A and then around the guide bar 18 in the direction of arrow B and finally around the guide bar 19 in the direction of arrow C. After the leading edge of the first printing-material web 1*a* has been pulled through directions A, B, and C, the first part printing-material web 1*a* is not wrapped around the offset bars 8, 9. Rather, the first part printing-material web 1*a* touches the offset bars tangentially at most in this configuration. If the offset bars 8, 9 have a smaller diameter than the guide bars 18, 19, the offset bars 8, 9 may not be touched at all by the first part printing-material web 1*a*. However, the separation of first part printing-material web 1*a* from the offset bars 8, 9 is not required during the threading operation. Because the threading process is relatively slow, only slight friction occurs between the offset bars 8, 9 and the first part printing-material web 1*a* if contact is made during threading.

Referring now to FIGS. 2*a* and 2*c*, the second part printing-material web 1*b* is also threaded by the second threading apparatus 16 correspondingly to the first part printing-material web 1*a*. During the threading operation, said second part printing-material web 1*b* maintains its original direction of movement without being offset and at most, tangentially touches the offset bars 10, 11. Downstream of the longitudinal cutting device 4, the second part printing-material web 1*b* is gripped at the point 17, or slightly downstream of the point 17, from above and below by covering pieces of a threading point 40 (shown schematically in FIG. 2*c*), which may, for example, contain a permanent-magnetic material and c1*a* mp the leading end of the part printing-material web 1*b* firmly by the magnetic attraction. The threading point 40 is pulled by a pulling device 41 (also shown schematically in FIG. 2*c*) which is guided by the guide rail 16. Before starting the threading of the second part printing-material web 1*b*, the upper of the two covering pieces preferably "sticks" underneath a metal sheet, which is likewise magnetic, while the lower covering piece rests on a holder, arranged underneath the threading path of the second part printing-material web 1*b* so that before the leading end of the part printing-material web 1*b* runs in, the covering pieces do not yet attract each other so powerfully that they would fold together. On the other hand, the upper covering piece sticks to the sheet metal holder only with such a low magnetic force that, when the pulling movement is started, the threading point 40 is pulled off it.

When a sensor 22 such, for example, as an optical sensor with a photocell registers the entry of the printing-material web 1, for example on the basis of a changing reflection of the light radiated from a light source, the longitudinal cutting device 4 and the threading apparatus 16 are simultaneously activated to cut the printing-material web 1 and grip the leading end of the second part printing-material web 1*b* produced thereby. This operation is already known from reference DE 44 09 693 C1. Instead of using the covering pieces which attract each other magnetically, the threading point 40 of the threading apparatus 16 which waits for the leading end of the second part printing-material web 1*b* at the location 17 may also have an adhesive strip which is stuck to the leading start of the part printing-material web by means of a pressure roll 23 in response to a signal from the sensor 22. The pressure roll 23 cooperates with a roll 24 on the rear side of the part printing-material web 1*b*. In this embodiment, the pressure roll 23 presses against the second part printing-material web 1*b* only during the sticking operation and returns to its original position after the sticking operation has been completed. A pneumatic device with a pneumatic cylinder may, for example, be used to move the pressure roll 23.

In another exemplary embodiment, the threading point 40 of the threading apparatus 16 has pins, such as a pin cylinder in a folding unit also has. The pins engage the leading end of the second part printing-material web 1*b* at the location 17 after being cut in the longitudinal direction by the longitudinal cutting device 4. Generally, the first and second part printing-material webs 1*a* and 1*b* have the same width; however, the width ratio may also be 1:2, 1:3, or any other ratio which may be required for a specific application. The width of the threading points must be adapted according to the ratio.

Figure 3:
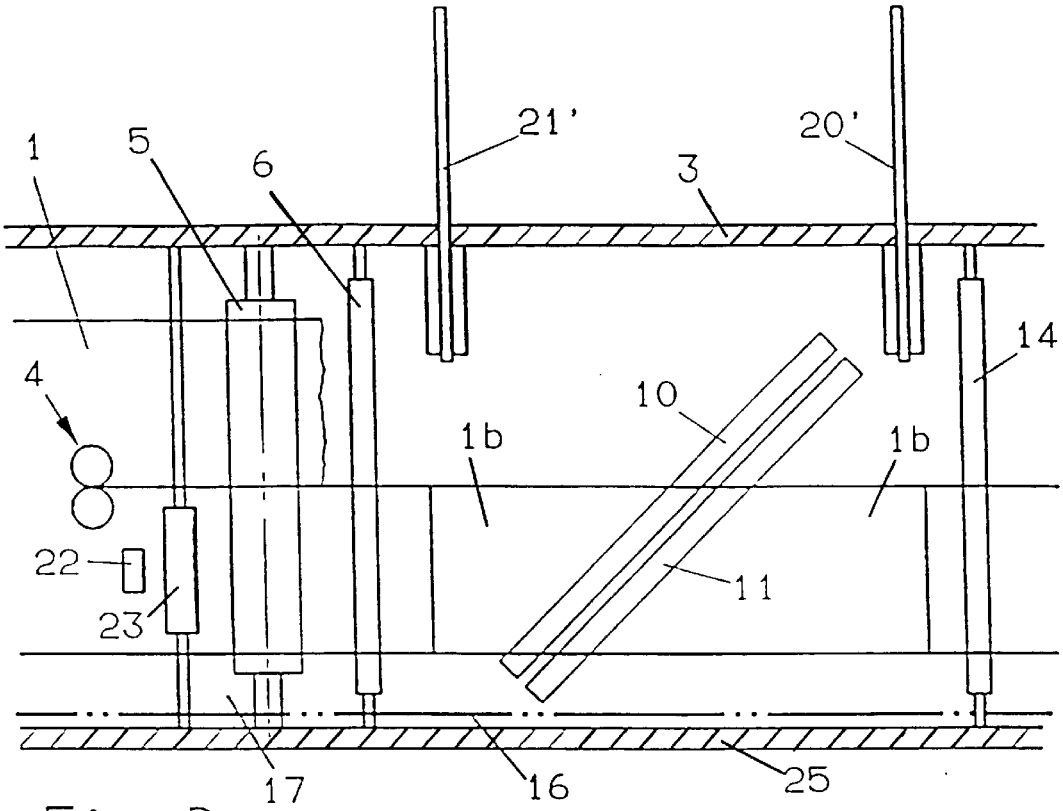
FIG. 3 is a plan view of an offset bar region of the printing machine of FIG. 2*c* after removal of the guide bars from the web course of the other of the two part printing-material webs after the threading operation has been completed.
Figure 4:
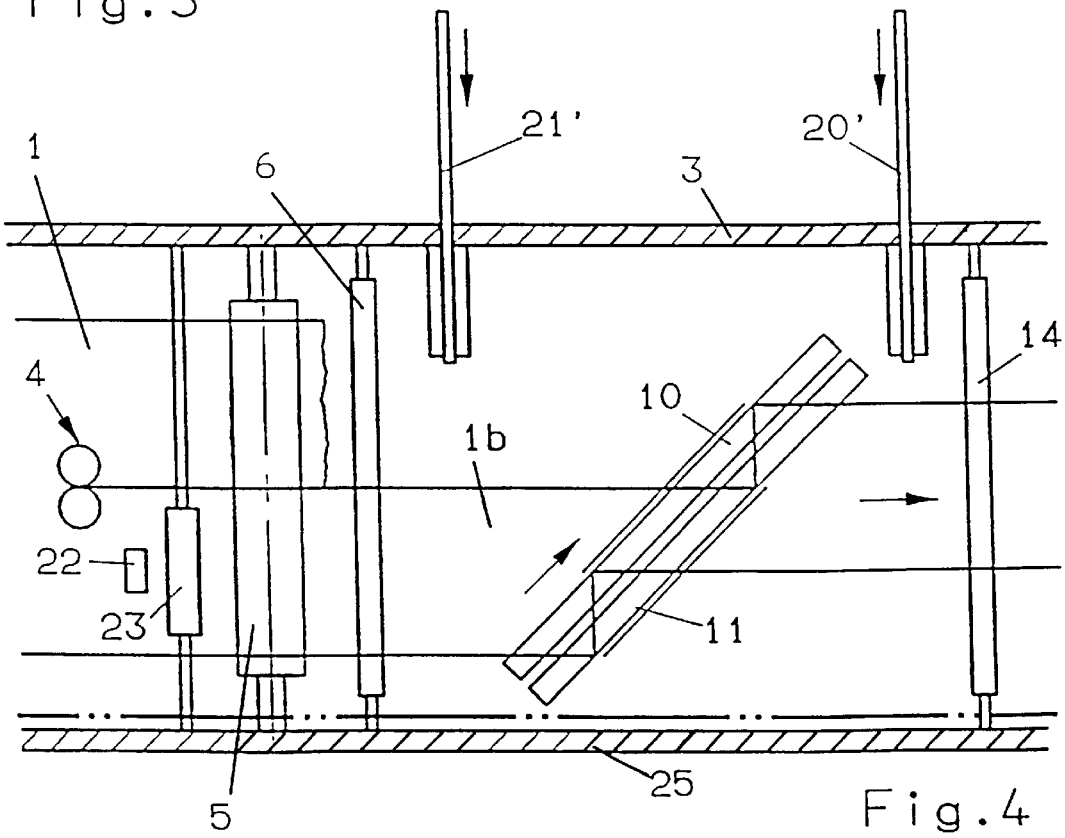
FIG. 4 is a plan view of an offset bar region of the printing machine of FIG. 3 after the other of the part printing-material web has been pulled taut following the withdrawal of the guide bar.

Referring now to FIG. 3, after the second part printing-material web 1*b* has been threaded through the region of the offset bars 10, 11 as far as upstream of the folding former, for example, the guide bars 20, 21 are withdrawn from the threading path of the second part printing-material web 1*b*. The withdrawal operation may be performed manually or by an electric motor. The withdrawal may also be executed by a pneumatic or hydraulic cylinder. The guide bars 20, 21 are preferably designed as piston rods of this cylinder in the latter case. After withdrawal of the guide bars, the second part printing-material web 1*b* hangs loosely in the region of the offset bars 10, 11. To avoid a paper break, the second part printing-material web 1*b* must then be drawn taut carefully, the desired offset of the part printing-material web 1*b* in the direction toward the center being produced between the side walls 3 and 25 as a result of wrapping around the offset bars 10, 11 now begins to occur as shown in FIG. 4. Correspondingly, the guide bars 18, 19 are withdrawn from the course of the first part printing-material web 1*a* so that after it has been drawn taut over the offset bars 8, 9, the first part printing-material web 1*a* assumes the course shown in FIG. 1*b*.

Figure 5:
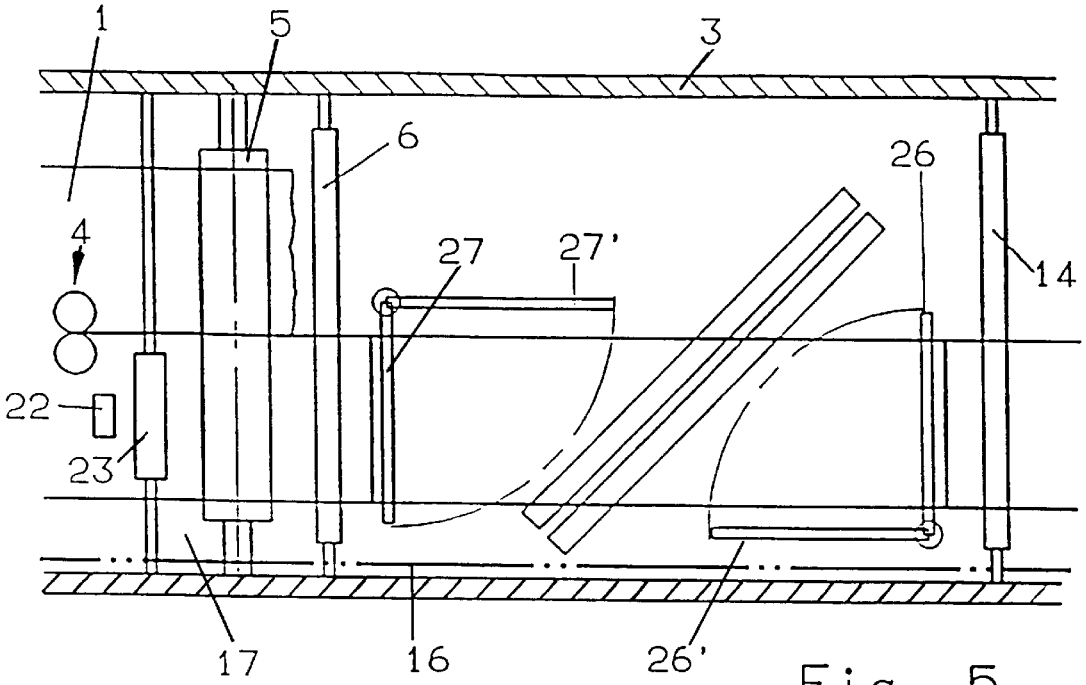
FIG. 5 is a plan view of another embodiment of an offset bar construction having pivotable guide bars.

Referring now to FIG. 5, instead of guide bars 18–21 which can be withdrawn from the course of the part printing-material webs 1*a* and 1*b*, pivotable guide bars 26, 27 as shown here with reference to the second part printing-material web 1*b*, may be used which pivot away into positions 26', 27' after the threading operation has been completed, so that said guide bars 26 and 27 do not interfere during continuous printing.

Figure 6:
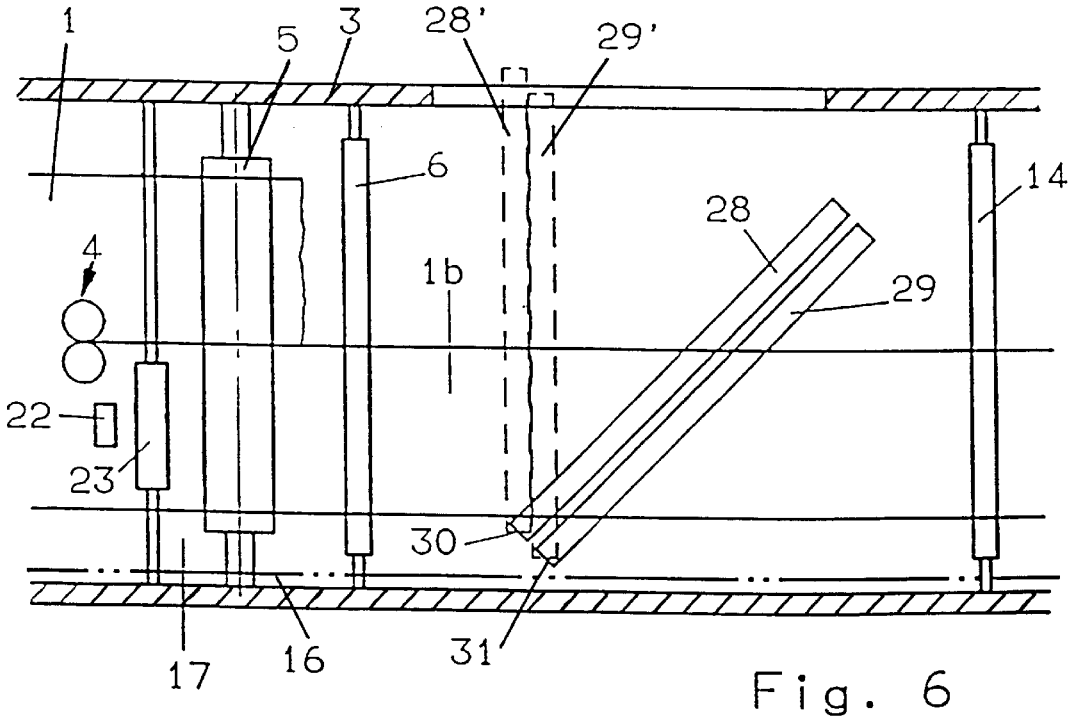
FIG. 6 is a plan view of yet another embodiment of an offset bar construction in which the offset bars are pivotably mounted.

In a further exemplary embodiment shown in FIG. 6, offset bars 28, 29 pivotally mounted on pivoting bearings 30, 31 in the printing machine 50 on one side are used and take over the function of the guide bars 20, 21 during the threading operation. The offset bars 28, 29 are then pivoted into the positions 28', 29' by the pivoting bearings 30, 31 after the threading operation is completed. In both the pivotable guide bars 26, 27 and the pivotable offset bars 28, 29, the pivoting motion is may be effected either manually or by a motor such, for example, as pneumatic cylinders.

The invention provides an aid for threading a printing-material web 1 or first and second part printing-material webs 1*a*, 1*b*, which are produced from the printing-material web 1 by a longitudinal cutting device 4. The aid ensures threading by machine by threading apparatus 2, 16 even in the region of offset bars 8, 9, 10, 11. Guide bars are introduced into the course of the printing-material web 1 or the first and second part printing-material webs 1*a*, 1*b* only during the threading operation. During the threading operation the printing-material web 1, 1*a*, 1*b* wraps around the guide bars instead of the offset bars 8, 9, 10, 11. The guide bars 18, 19, 20, 21 are either withdrawn from or pivoted out of the web course after the threading operation. The offset bars 28, 29 may also be pivotably mounted on one side to undertake the function of the guide bars during the threading operation. The offset bars 10, 11 may also be designed as guide rolls.

The invention is not limited by the embodiments described above which are presented as examples only but can be modified in various ways within the scope of protection defined by the appended patent claims.

I claim:

1. A threading apparatus for threading the start of a printing-material web through an offset bar region of a rotary printing machine using a pulling device for pulling a threading point connected to the start of the printing-material web, the printing machine having a path for the printing material web along a longitudinal direction of the printing machine, said apparatus comprising:

a guide rail arrangeable parallel to the longitudinal direction of the printing machine alongside the path in the offset bar region, said guide rail being guidably connectable to the pulling device so that the threading point is guidable through the offset bar region by said guide rail;

a pair of parallel offset bars arranged in said offset bar region for laterally offsetting the printing material web; and guide means extendable perpendicular to the longitudinal path for receiving the printing-material web during the threading operation, said guide means being arranged relative to said guide rail so that the printing material is threadable around said guide means instead of said offset bars, said guide means being removable from the longitudinal path.

2. The threading apparatus of claim 1, wherein said guide means comprises one of a guide bar and a guide roll.

3. The threading apparatus of claim 1, further comprising means for withdrawing said guide means from the longitudinal path of the printing-material web.

4. The threading apparatus of claim 3, wherein said means for withdrawing comprises one of a manual or an electrical means.

5. The threading apparatus of claim 3, wherein said means for withdrawing comprises one of a pneumatic device and a hydraulic device.

6. The threading apparatus of claim 5, wherein said guide means comprises a piston rod of said one of a pneumatic device and a hydraulic device.

7. The threading apparatus of claim 1, wherein said pair of parallel offset bars are pivotable to a position perpendicular to the longitudinal path during the threading operation, and wherein said guide means comprise said offset bars in said position perpendicular to the longitudinal path.

8. A method for threading the start of a printing-material web through an offset bar region of a printing machine using a threading point for gripping the start of the printing material web and a pulling device guided by a guide rail along the offset bar region for pulling the threading point and the printing-material web through the offset region, comprising the steps of:

a. inserting guide elements into the offset bar region upstream and down stream of offset bars such that a longitudinal axis of the guide elements is substantially perpendicular to a course of the printing material web;

b. threading the printing material web through the offset bars and around the guide elements instead of the offset bars;

c. withdrawing the guide elements from the course of the printing-material web after step b.; and d. pulling the printing-material web taut over the offset bars after step c.

* * * * *